US008371920B2

(12) United States Patent
Gomez et al.

(10) Patent No.: US 8,371,920 B2
(45) Date of Patent: Feb. 12, 2013

(54) GAMING SYSTEM HAVING MULTIZONE SELECTION FEATURE

(75) Inventors: Benjamin T. Gomez, Chicago, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 591 days.

(21) Appl. No.: 12/446,266

(22) PCT Filed: Oct. 19, 2007

(86) PCT No.: PCT/US2007/022289

§ 371 (c)(1),
(2), (4) Date: Apr. 20, 2009

(87) PCT Pub. No.: WO2008/057188

PCT Pub. Date: May 15, 2008

(65) Prior Publication Data

US 2010/0317425 A1 Dec. 16, 2010

Related U.S. Application Data

(60) Provisional application No. 60/855,880, filed on Nov. 1, 2006.

(51) Int. Cl.
*A63F 9/24* (2006.01)

(52) U.S. Cl. ..... 463/17

(58) Field of Classification Search ..... 463/17
See application file for complete search history.

(56) References Cited

U.S. PATENT DOCUMENTS 6,645,071 B2 * 11/2003 Perrie et al. ..... 463/16
8,016,656 B2 * 9/2011 Berman et al. ..... 463/13
2002/0045475 A1 4/2002 Glavich et al.
2005/0054415 A1 * 3/2005 Kaminkow et al. ..... 463/16
2005/0181855 A1 * 8/2005 Englman et al. ..... 463/16
2006/0079317 A1 4/2006 Flemming et al.
2008/0102916 A1 * 5/2008 Kovacs et al. ..... 463/16

FOREIGN PATENT DOCUMENTS

GB 2393022 A 3/2004
WO WO 2006/104731 10/2006

OTHER PUBLICATIONS

Written Opinion corresponding to co-pending International Patent Application Serial No. PCT/US2007/022289, European Patent Office; dated Apr. 18, 2008; 7 pages.

International Search Report corresponding to co-pending International Patent Application Serial No. PCT/US2007/022289, European Patent Office; dated Apr. 18, 2008; 3 pages.

* cited by examiner

*Primary Examiner* — William D Coleman
(74) *Attorney, Agent, or Firm* — Nixon Peabody LLP

(57) ABSTRACT

A gaming system for conducting a wagering game includes a wager input device and a display for displaying a randomly selected outcome. The randomly selected outcome is selected from a plurality of possible outcomes. The gaming system further includes a controller operative to display a multi-zone selection feature. The multi-zone selection feature comprises a plurality of zones, each zone having a plurality of selectable elements arranged in an array. Each selectable element is associated with a selection result. The controller is further operative, in response to selection of a first selectable element in a first one of the zones, to provide the selection result associated with a second selectable element in a second one of the zones.

22 Claims, 13 Drawing Sheets

GAMING SYSTEM HAVING MULTIZONE SELECTION FEATURE

CROSS-REFERENCE TO RELATED APPLICATIONS

This application is a U.S. National Stage of International Application No. PCT/US2007/022289, filed Oct. 19, 2007, which claims the benefit of U.S. Provisional Application No. 60/855,880, filed on Nov. 1, 2006, both of which are incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having a multi-zone selection feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators. The present invention is directed to solving these and other problems.

SUMMARY OF THE INVENTION

According to one aspect of the present invention, a gaming system for conducting a wagering game includes a wager input device and a display for displaying a randomly selected outcome. The randomly selected outcome is selected from a plurality of possible outcomes. The gaming system further includes a controller operative to display a multi-zone selection feature. The multi-zone selection feature comprises a plurality of zones, each zone having a plurality of selectable elements arranged in an array. Each selectable element is associated with a selection result. The controller is further operative, in response to selection of a first selectable element in a first one of the zones, to provide the selection result associated with a second selectable element in a second one of the zones.

According to another aspect of the invention, a method of conducting a wagering game on a gaming system comprises receiving a wager via a wager input device. The method further comprises displaying a randomly selected outcome, the randomly selected outcome selected from a plurality of possible outcomes. The method further comprises, in response to a triggering event, displaying a multi-zone selection feature comprising a plurality of zones, each zone having a plurality of selectable elements arranged in an array, each selectable element associated with a selection result selected from plurality of possible selection results. The method further comprises selecting a first selectable element in a first one of the zones, and in response to the selecting, providing (i) a first selection result associated with the first selectable element, and (ii) a second selection result associated with a second selectable element in a second one of the zones.

According to yet another aspect of the invention, a method of conducting a wagering game on a gaming system comprises receiving a wager via a wager input device. The method further comprises displaying a randomly selected outcome, the randomly selected outcome selected from a plurality of possible outcomes. The plurality of outcomes including a start-bonus outcome. The method further comprises displaying a multi-zone selection feature comprising a first zone, a second zone and a third zone, the first zone having a plurality of selectable elements arranged in a first array, the second zone having a plurality of selectable elements arranged in a second array, the third zone having a plurality of selectable elements arranged in a third array. The method further comprises selecting a first selectable element in the first zone. The method further comprises providing a first selection result associated with the first selectable element, providing a second selection result associated with a second selectable element in the second zone, and providing a third selection result associated with a third selectable element in the third zone.

According to yet another aspect of the invention, a computer readable storage medium is encoded with instructions for directing a gaming system to perform the above method.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
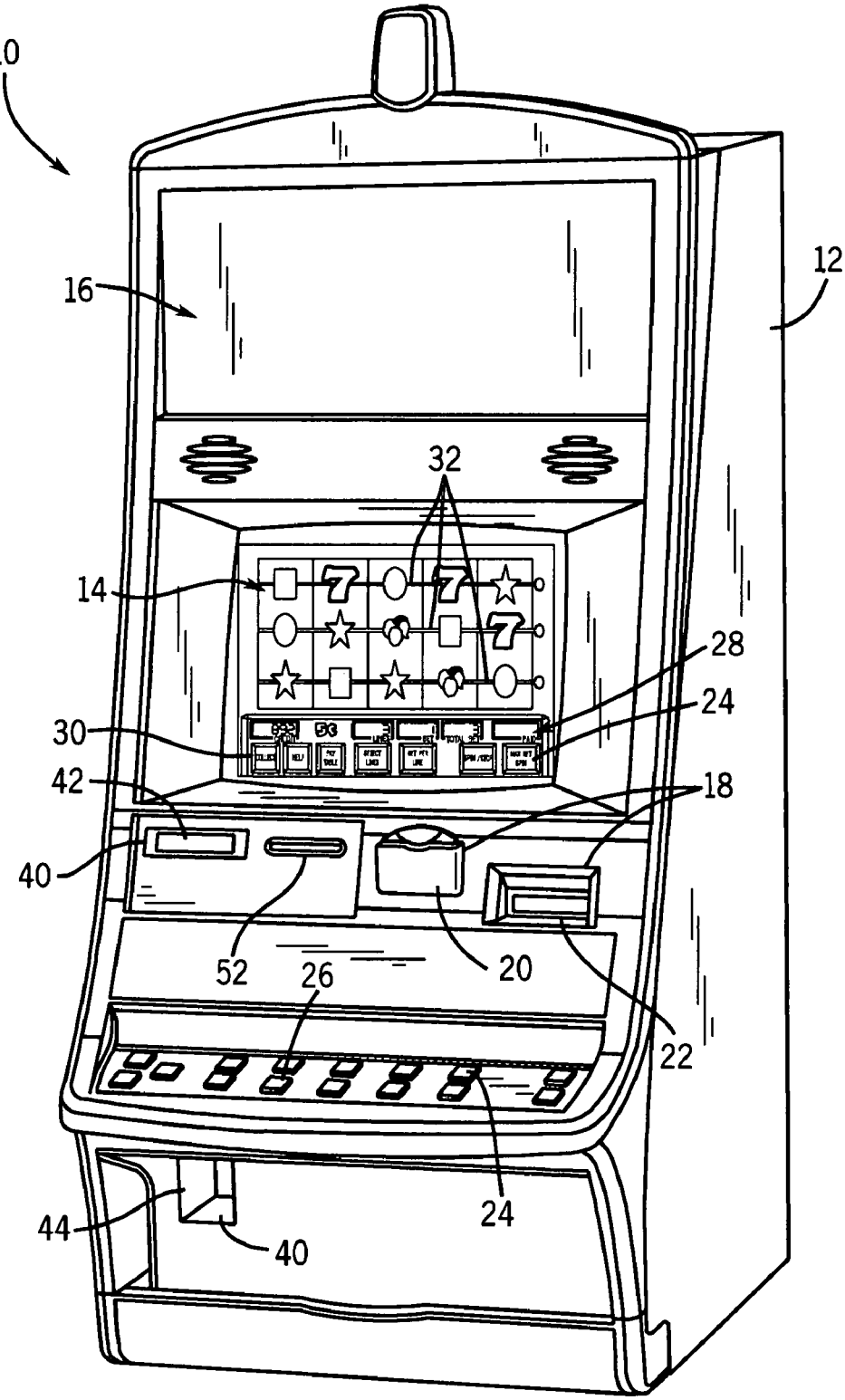
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
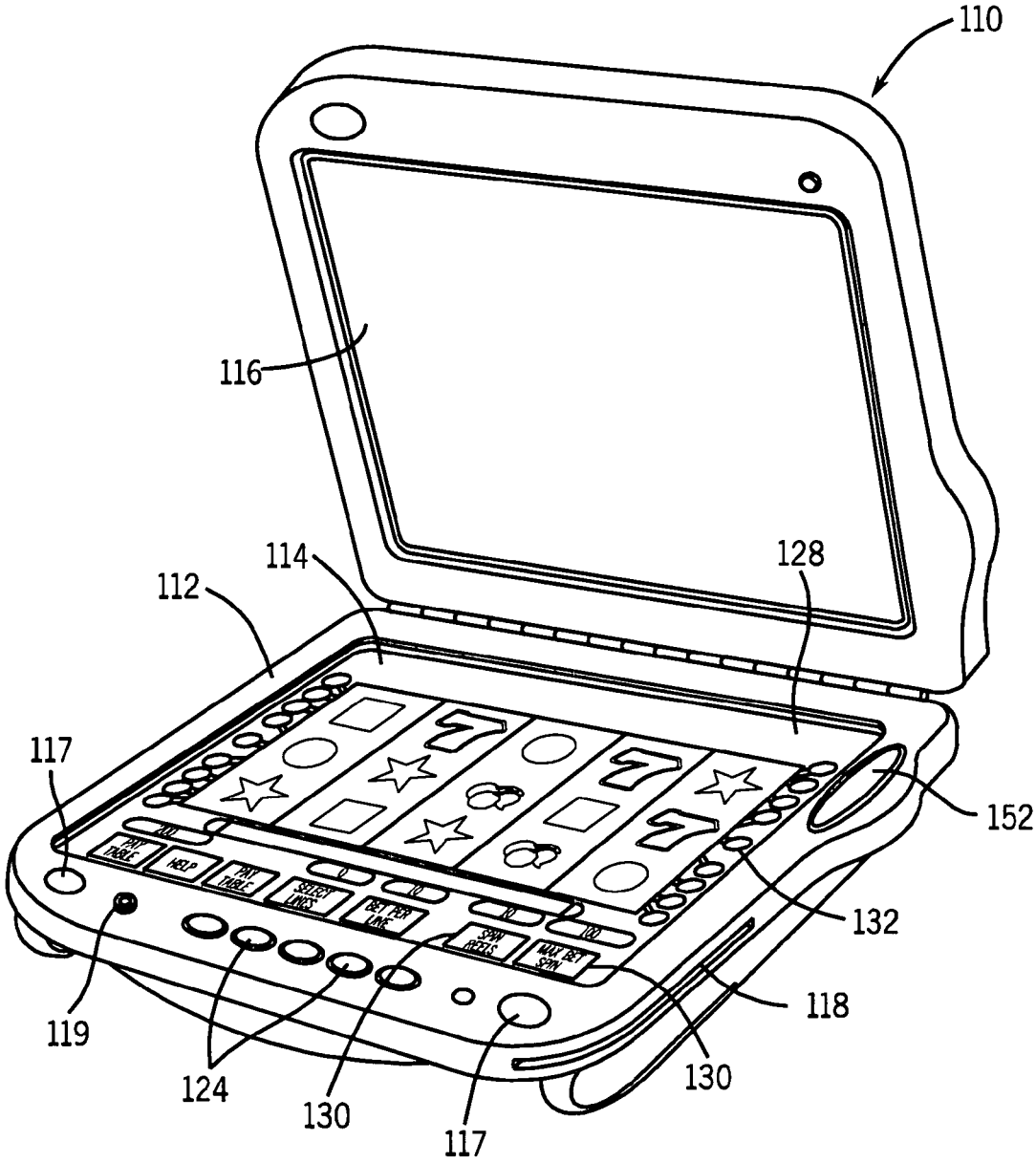
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
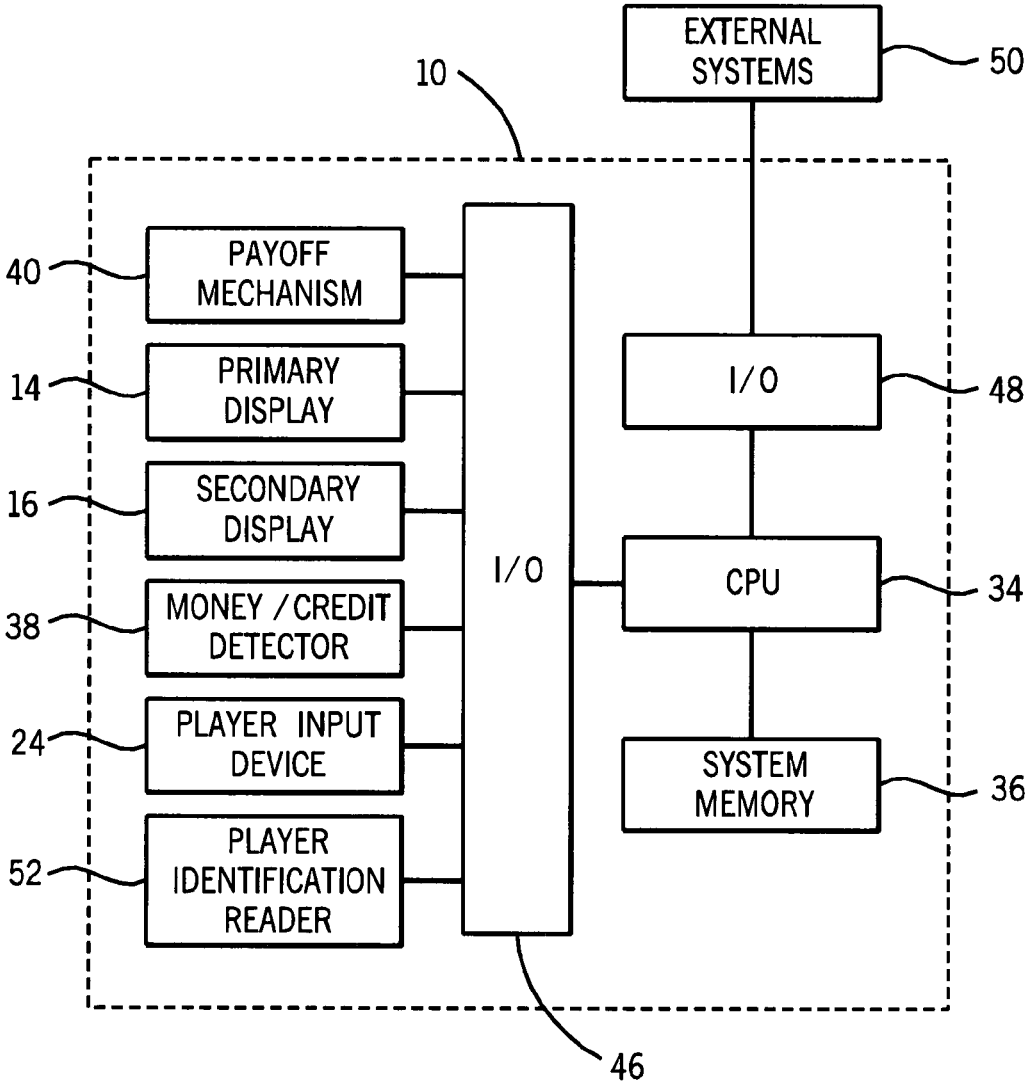
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10, 110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10, 110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
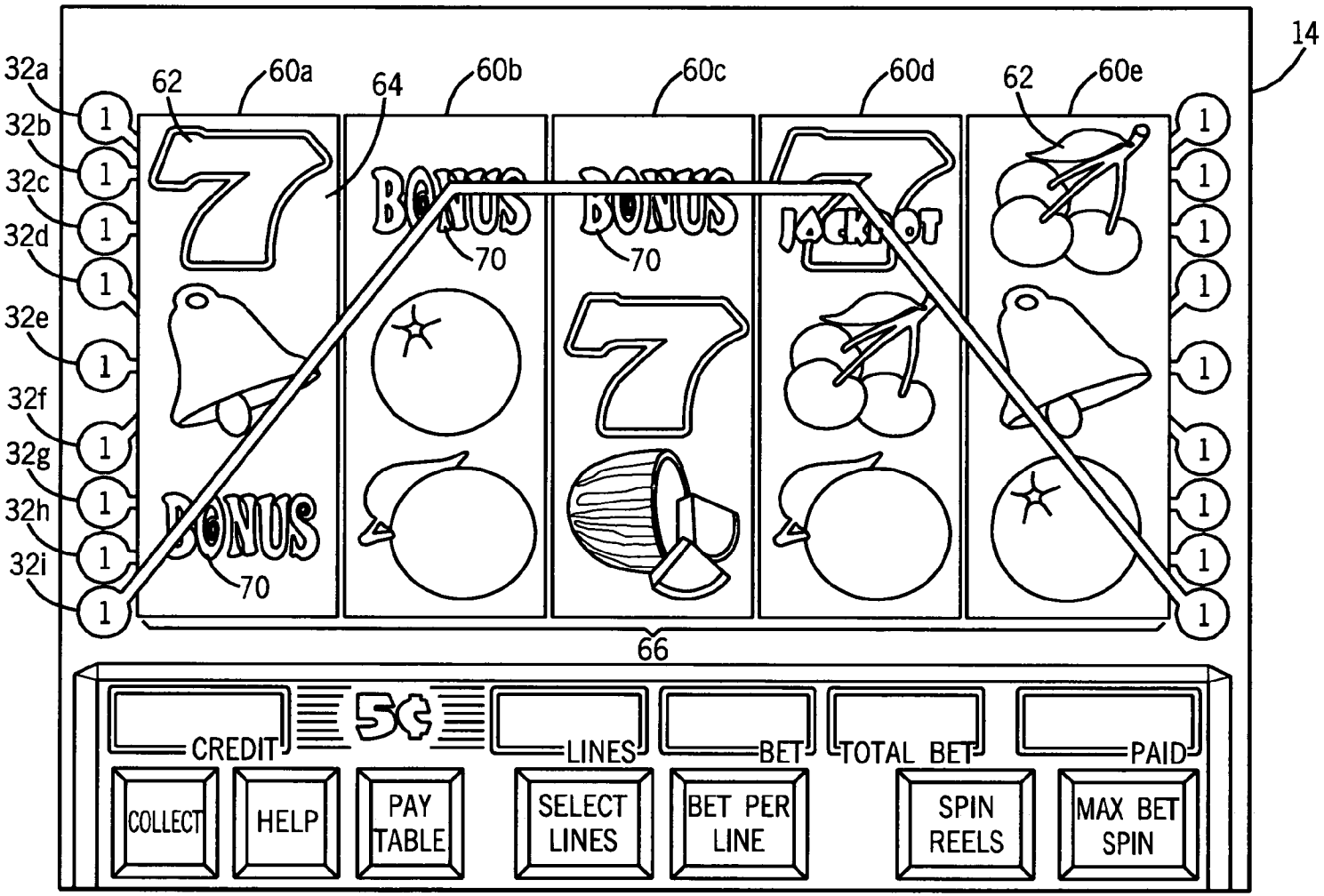
FIG. 3 is a front view of the display of the gaming machine.

Turning now to FIG. 3, the primary display 14 of the gaming machine 10 displays a plurality of symbol bearing reels 60*a-e*. Each of the reels 60*a-e* includes a plurality of symbols 62 positioned along a reel strip 64. The reels 60*a-e* may be mechanical or electromechanical reels, or may be virtual reels visually displayed in a graphic format on the primary display 14. The symbols 62 on the reels 60*a-e* are varied (i.e. spun and stopped) to display an array 66 of symbols 62 on the display 14. The outcomes displayed on the reels 60*a-e* may be varied in other ways as well, such as cascading the symbols 62 on the reels 60*a-e*. One or more paylines 32*a-i* which extend across the array 66 and through the symbols 62 are indicated on the display 14. The combinations of symbols 62 landing on each payline 32*a-i* are evaluated against a predetermined set of winning combinations contained in a paytable. Winning combinations of symbols 62 which fall on an active payline 32*a-i* trigger an award in accordance with amounts stored in the paytable. At least one outcome or combination of symbols 62 in the array 66 is a start-bonus outcome, such as the outcome depicted in FIG. 3. In this case, the start-bonus outcome is three BONUS symbols 70 landing on an active payline 32*i*. The occurrence of the start-bonus outcome triggers a bonus, which in this case, is a multi-zone selection feature bonus game. Other bonus trigger events may be utilized in addition to, in place of, or in conjunction with the payline trigger depicted in FIG. 3. For example, the bonus may be triggered randomly (a mystery trigger), based upon a particular quantity of trigger symbols in the array 66 regardless of paylines 32 (scatter trigger), amount of time played on a machine, amount of coin in, or any other triggering mechanism.

Figure 4:
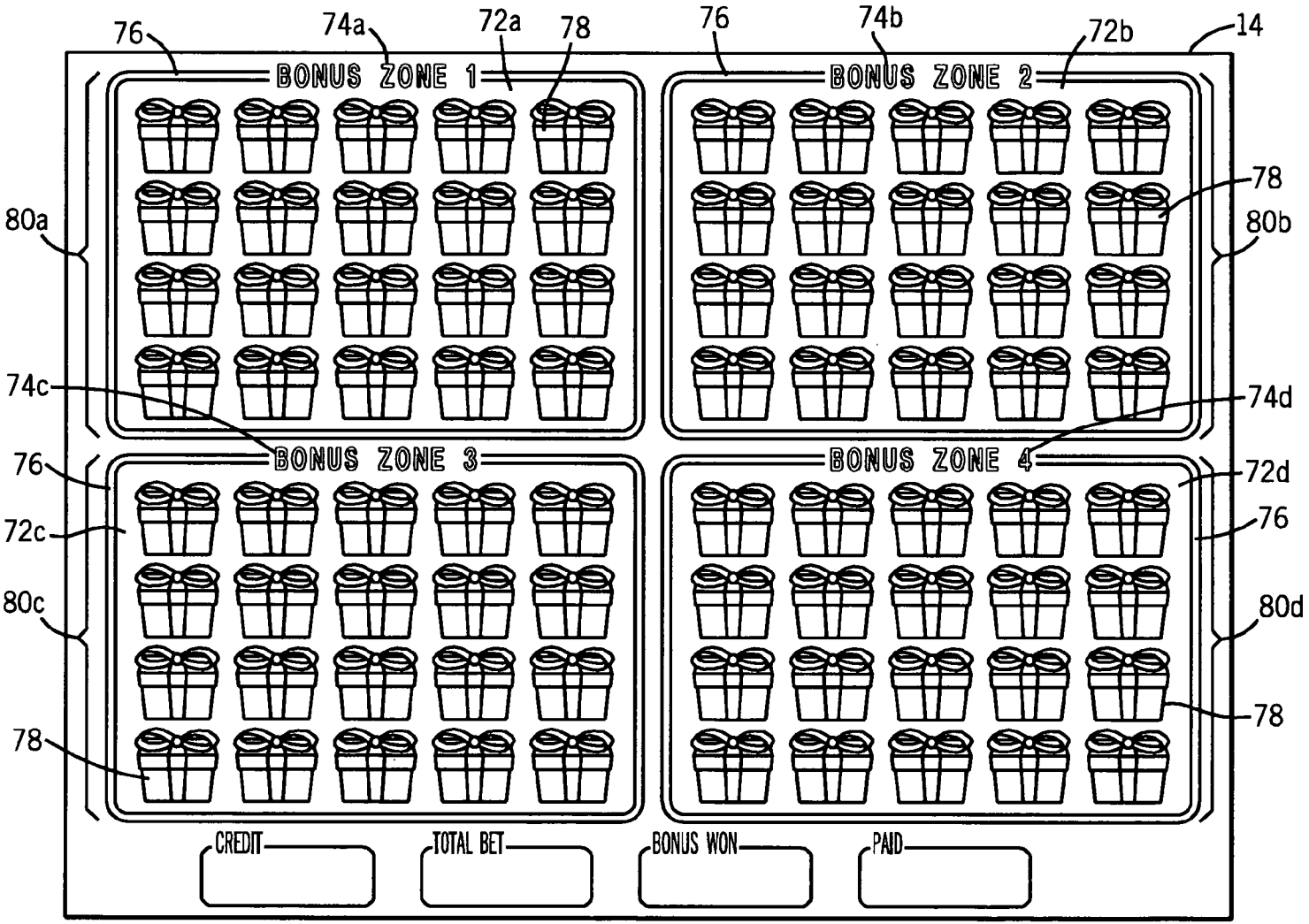
FIG. 4 is the display of the gaming machine displaying a multi-zone selection feature.

In this embodiment, the start-bonus outcome triggers a bonus game and causes the execution and display of a multi-zone selection feature described below in reference to FIGS. 4-12. In FIG. 4, an initial bonus screen is depicted on the display 14. The multi-zone selection feature comprises a plurality of zones 72*a,b,c,d* and may include zone labels 74*a,b,c,d* such as "Bonus Zone 1", "Bonus Zone 2", etc. Each zone 72 further includes a zone boundary 76 so as to designated the geographic border of the zone 72. In this embodiment, the zone boundary 76 for each zone 72 is a double solid line circumscribing each zone 72. The boundary 76 may take on many forms, including dotted or dashed lines, varying patterns, designs, or colors.

Within each zone 72 are a plurality of selectable elements 78, which in this embodiment are depicted as wrapped presents. The selectable elements 78 in each zone 72 are arranged in an array 80 comprising a plurality of rows and columns. In this embodiment, the array 80 in each zone 72 comprises twenty (20) selectable elements 78 arranged in four rows and five columns. In this way, all of the arrays 80*a,b,c,d* contained the same number of selectable elements, the same number of rows, and the same number of columns. In other words, the arrays 80*a,b,c,d* have the same geometric arrangement, or are congruent. In other embodiments, the zones 72 may have differing numbers of selectable elements 78. Moreover, in other embodiments, the arrays 80*a,b,c,d* in the different zones 72*a,b,c,d* may be arranged differently so as to have differing geometric shapes, differing numbers of rows, differing numbers of columns, or any combination thereof. Furthermore, the selectable elements 78 within each zone 72*a,b,c,d* may take on the same or differing graphical representations. For example, the selectable elements 78 in the first zone 72*a* may be wrapped present icons, while the selectable elements 78 in the second zone 72*b* are party hat icons. It should also be understood that the selectable elements 78 within any one zone 72*a,b,c,d* need not be of the same graphical representation, but may be represented as a plurality of different icons.

Figure 5:
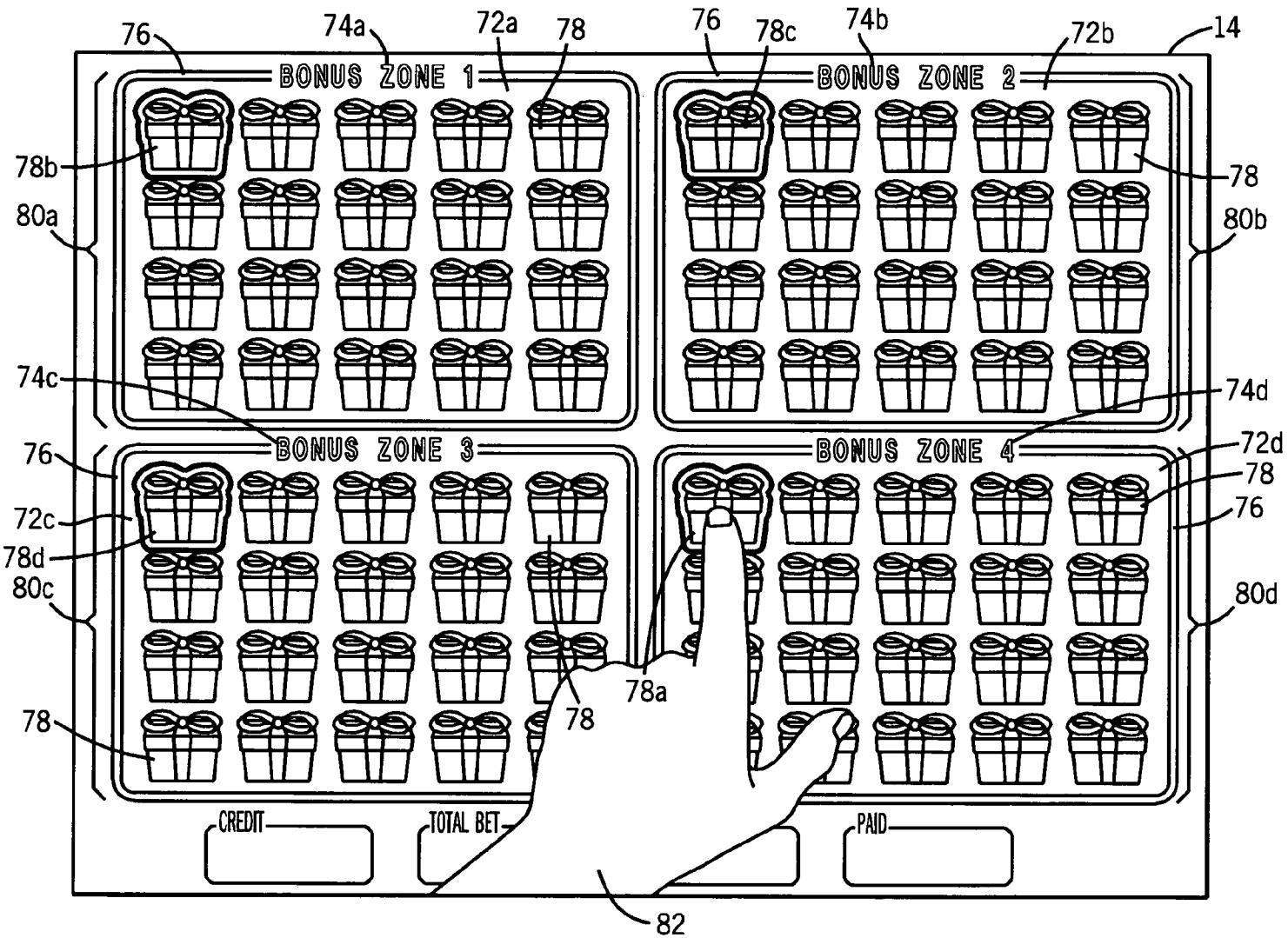
FIG. 5 is another screen shot of the multi-zone selection feature of FIG. 4.

Turning to FIG. 5, the player is permitted to make a selection of one of the selectable elements 78 in any of the four zones 72*a,b,c,d*. In this instance, the player 82 (represented by the player's hand and finger making a selection) has selected a first selectable element 78*a*, which is located in the upper left hand corner of the array 80*d* in the fourth zone 72*d*. Once selected, the first selectable element 78*a* is highlighted, or visually distinguished, in this case by providing an outline around the first selectable element 78*a*. Many varieties of highlighting may be utilized to visually distinguish a selected element from the remaining non-selected elements. Also highlighted are three other (unselected) selectable elements 78*b,c,d* which are located in the three other zones 72*a,b,c*. Also, it should be noted than in alternate embodiments, the selecting need not be performed by the player 82, but instead the selectable elements 78 may be selected randomly, in a predetermined order, or even by other players.

Figure 6:
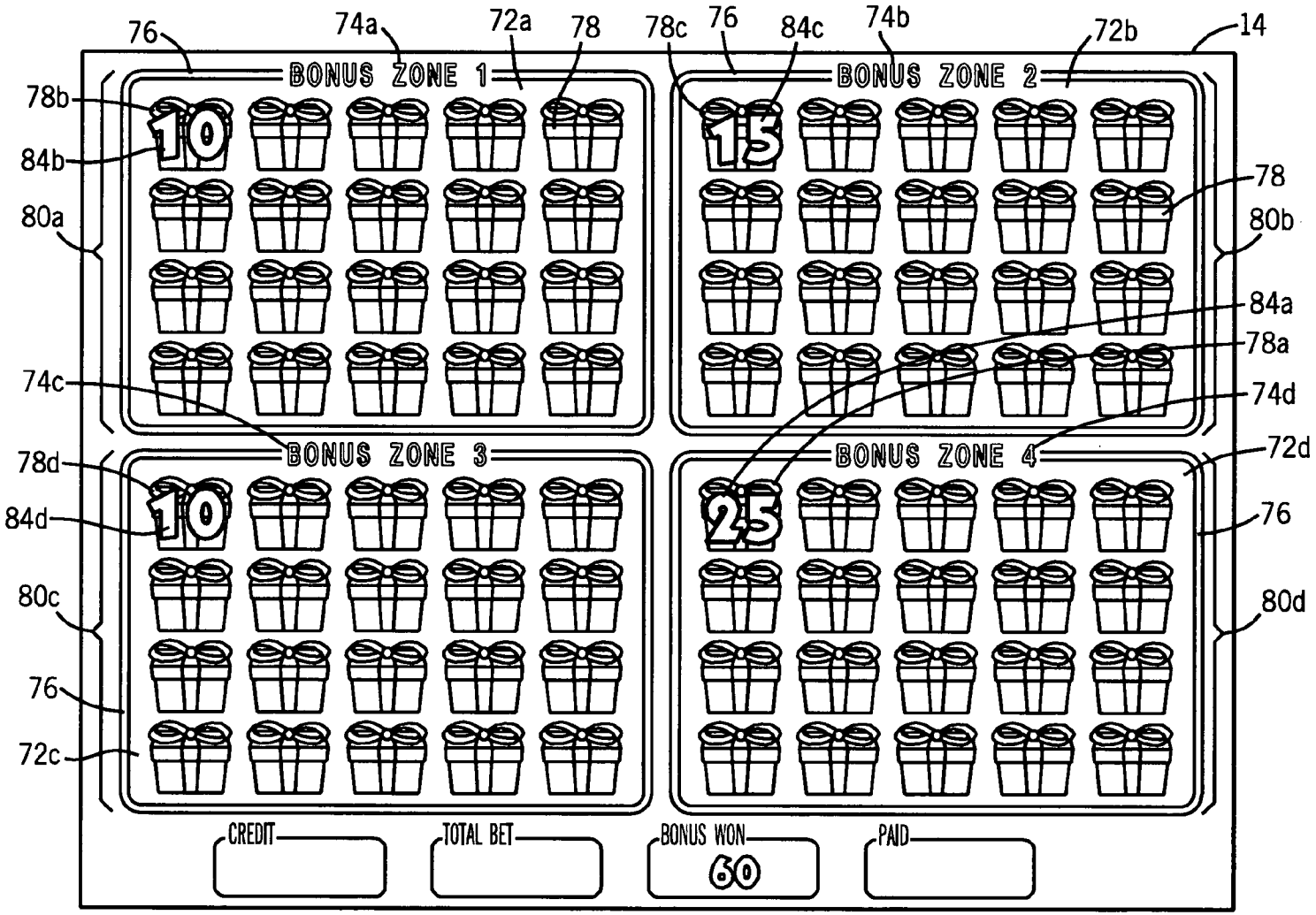
FIG. 6 is yet another screen shot of the multi-zone selection feature.

Turning to FIG. 6, in response to selecting the first selectable element 78*a*, the player is provided with a selection result 84*a* associated with the first selectable element 78*a* in the fourth zone 72*d*, which in this case is a credit award of 25 credits. Other selection results 84 are possible as well, including other awards, terminators, and rejuvenators, as described later herein in reference to FIGS. 8-10. In addition to being provided the selection result 84*a* associated with the selected first selectable element 78*a*, the player is also provided with the selection results 84*b,c,d* of one selectable element 78*b,c,d* in each of the other zones 72*a,b,c*. In this case, the player is also provided the selection result 84*b* associated with the selectable element 78*b* in the upper left hand corner of the array 80*a* of the first zone 72*a*, which in this case is an award of 10 credits. The player is also provided the selection result 84*c* associated with the selectable element 78*c* in the upper left hand corner of the array 80*b* in the second zone 72*b*, which in this case is an award of 15 credits. The player is also provided the selection result 84*d* associated with the selectable element 78*d* in the upper left hand corner of the array 80*c* in the third zone 72*c*, which in this case is an award of 10 credits. Therefore, by making one selection in the fourth zone 72*d*, the player has received selection results 84*a,b,c,d* in each of the four zones 72*a,b,c,d*, for which the player 82 has received a total award of 60 credits as displayed on the display 14, in the display region entitled "Bonus Won". In an embodiment, the four selection results 84*a,b,c,d* are revealed and provided to the player simultaneously. In other embodiments, the selection results 84*a,b,c,d* are revealed and provided to the player sequentially, or in some other predetermined order and timing relation.

In this embodiment, the player is permitted to select from any of the selectable elements 78. When the player selects a selectable element 78*a* in one zone 72*d*, he is provided the selection result 84*a* associated with that element 78*a*, as well as the selection results 84*b,c,d*, associated with one element 78*b,c,d* in each of the other zones 72*a,b,c*. In other words, one selection 78*a* reveals and provides the player with four results 84*a,b,c,d*, one of which is associated with the selected element 78*a* and three of which are associated with unselected elements 78*b,c,d*. In this embodiment, the unselected elements 78*b,c,d* for which selection results 84*b,c,d* are provided to the player 82 are located in the same position (upper left hand corner) in the array 80*a,b,c* in their respective zones 72*a,b,c* as the position of the selected element 78*a* in the array 80*d* of the fourth zone 72*d*. Stated differently, the player 82 is provided the selection results 84*b,c,d* associated with the unselected selectable elements 78*b,c,d* which are in the same row and column of the arrays 80*a,b,c* in each of the other zones 72*a,b,c* as the selected element 78*a*. However, in alternate embodiments, the unselected elements 78*b,c,d* for which selection results 84*b,c,d* provided to the player 82 may be located anywhere within the arrays 80*a,b,c* of the respective zones 72*a,b,c*. Moreover, the unselected elements 78*b,c,d* for which selection results 84*b,c,d* are provided to the player 82 may be located all in the same zone 72, or in two or more zones 72*a,b,c,d*, and need not be divided so as to occur only one element 78*b,c,d* per zone 72*a,b,c*.

Figure 7:
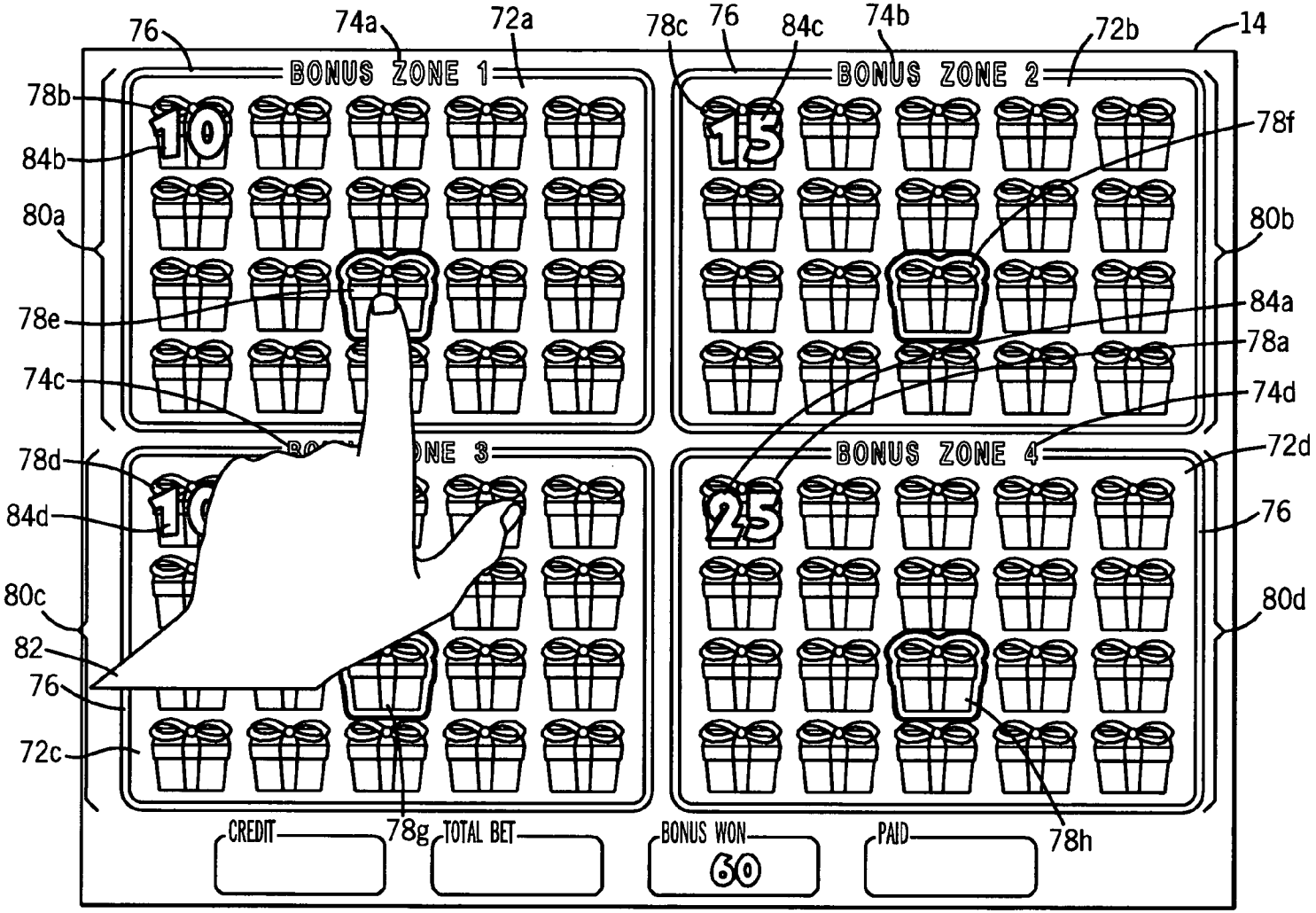
FIG. 7 is yet another screen shot of the multi-zone selection feature.

Turning to FIG. 7, the player 82 is permitted to make another selection from the remaining selectable elements 78. In this instance, the player 82 has selected another selectable element 78*e*, which in this case is located in the first zone 72*a*. The selected element 78*e* is highlighted, as are the unselected selectable elements 78*f,g,h* in the same position in their respective arrays 80*b,c,d* in other zones 72*b,c,d* as the selected element 78*e* in its array 80*a*. As before, the player 82 will be provided with selection results 84 associated with each of the four elements 78*e,f,g,h*.

Figure 8:
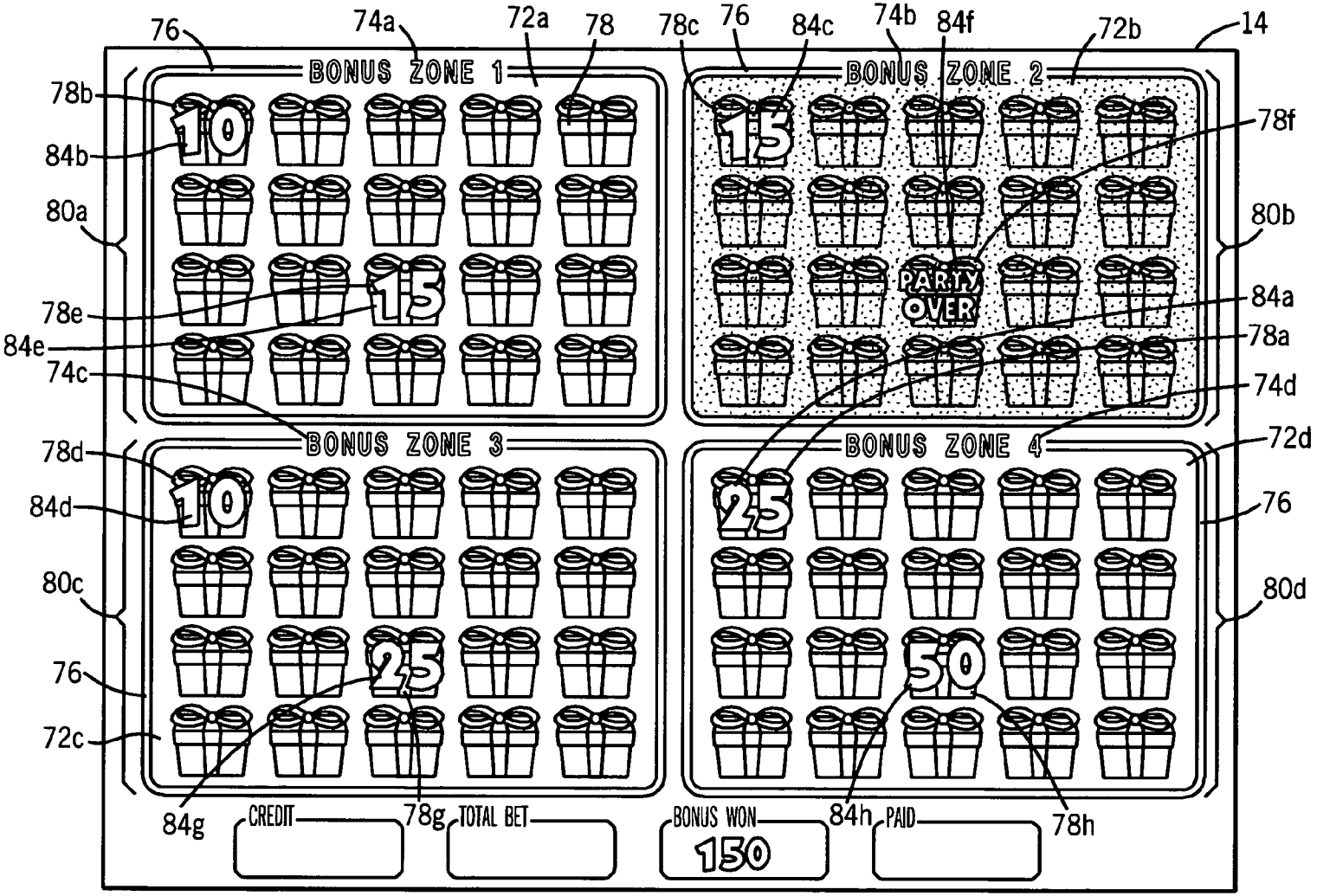
FIG. 8 is yet another screen shot of the multi-zone selection feature.

In FIG. 8, the player 82 is provided four selection results 84*e,f,g,h*. The player 82 is awarded a selection result 84*e* associated with the selected element 78*e*, which in this case is 15 credits. The player 82 is also provided with the selection results 84*f,g,h* of the three unselected elements 78*f,g,h* which correspond in location in their respective arrays 80*b,c,d*. These include the selection result 84*g* in the third zone 72*c* which is a credit award of 25 credits, and the selection result 84*h* in the fourth zone 72*d* which is a credit award of 50 credits. The selection result 84*f* provided from the second zone 72*b* is a different type of selection result, which in this case is a terminator. When a selection result 84*f* which is a terminator is provided, the zone 72*b* containing that result 84*f* is deactivated such that no further selections may be made from the deactivated zone 72*b*, and no further selection results 84 may be provided from that zone 72*b*. This deactivation may be visually communicated to the player 82, as in FIG. 8, by shading out or "graying" out the deactivated zone 72*b*. Moreover, the terminator selection result 84*f* itself may be communicate such deactivation, such as in this instance wherein the terminator states "Party Over."

Figure 9:
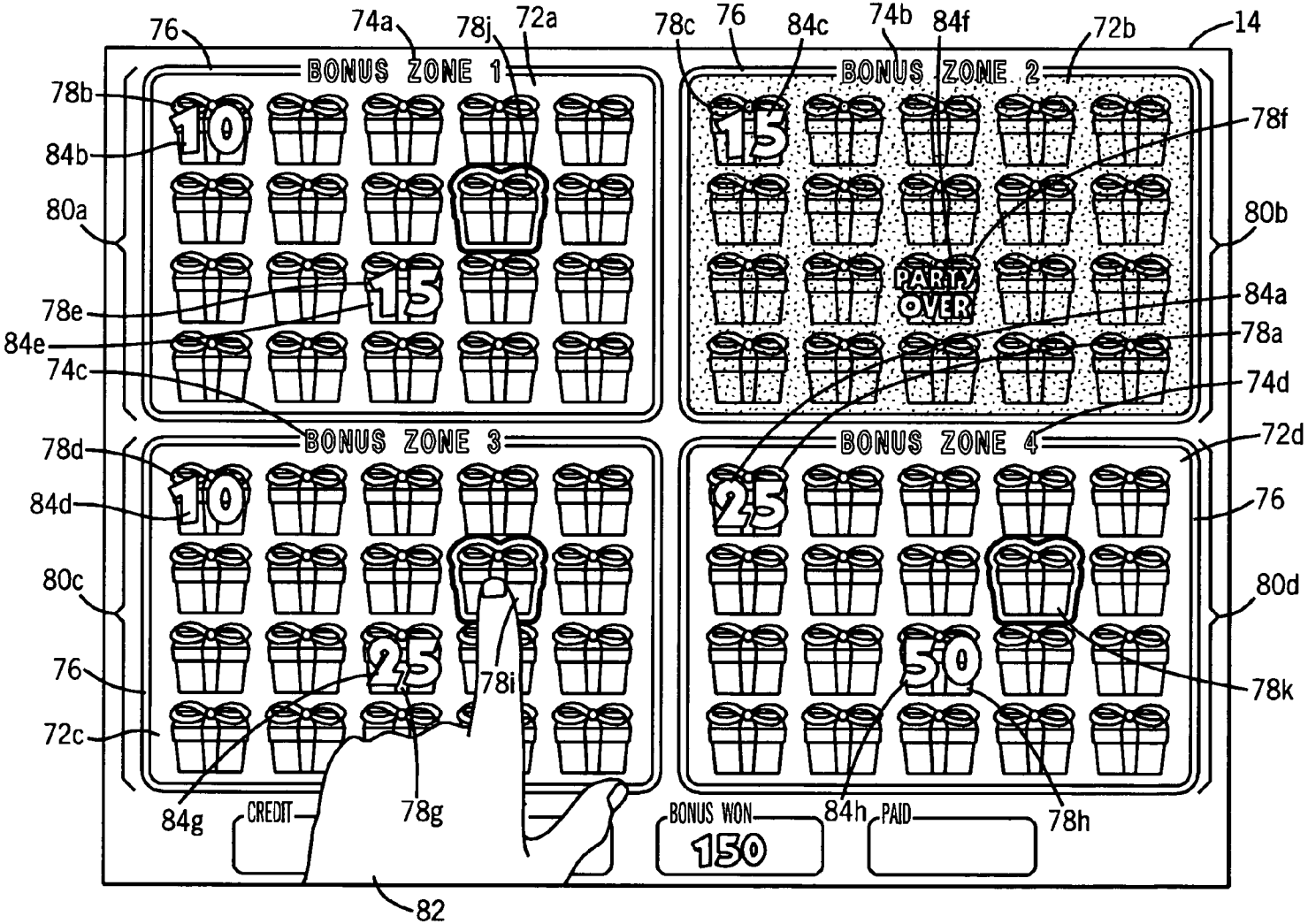
FIG. 9 is yet another screen shot of the multi-zone selection feature.

In FIG. 9, the player 82 is once again permitted to make a selection from the remaining active selectable elements 72. However, as stated, selection from the deactivated zone 72*b* is not permitted. In this instance, the player 82 has made yet another selection of a selectable element 78*i*, which in this case is located in the third zone 72*c*. The selected element 78*i* is again highlighted to indicate that it will be provided. Also highlighted are the unselected selectable elements 78*j,k* in the other two active zones 72*a,d* which correspond in position in their respective arrays 80*a,d* to the selected element 78*i* within its array 80*c*.

Figure 10:
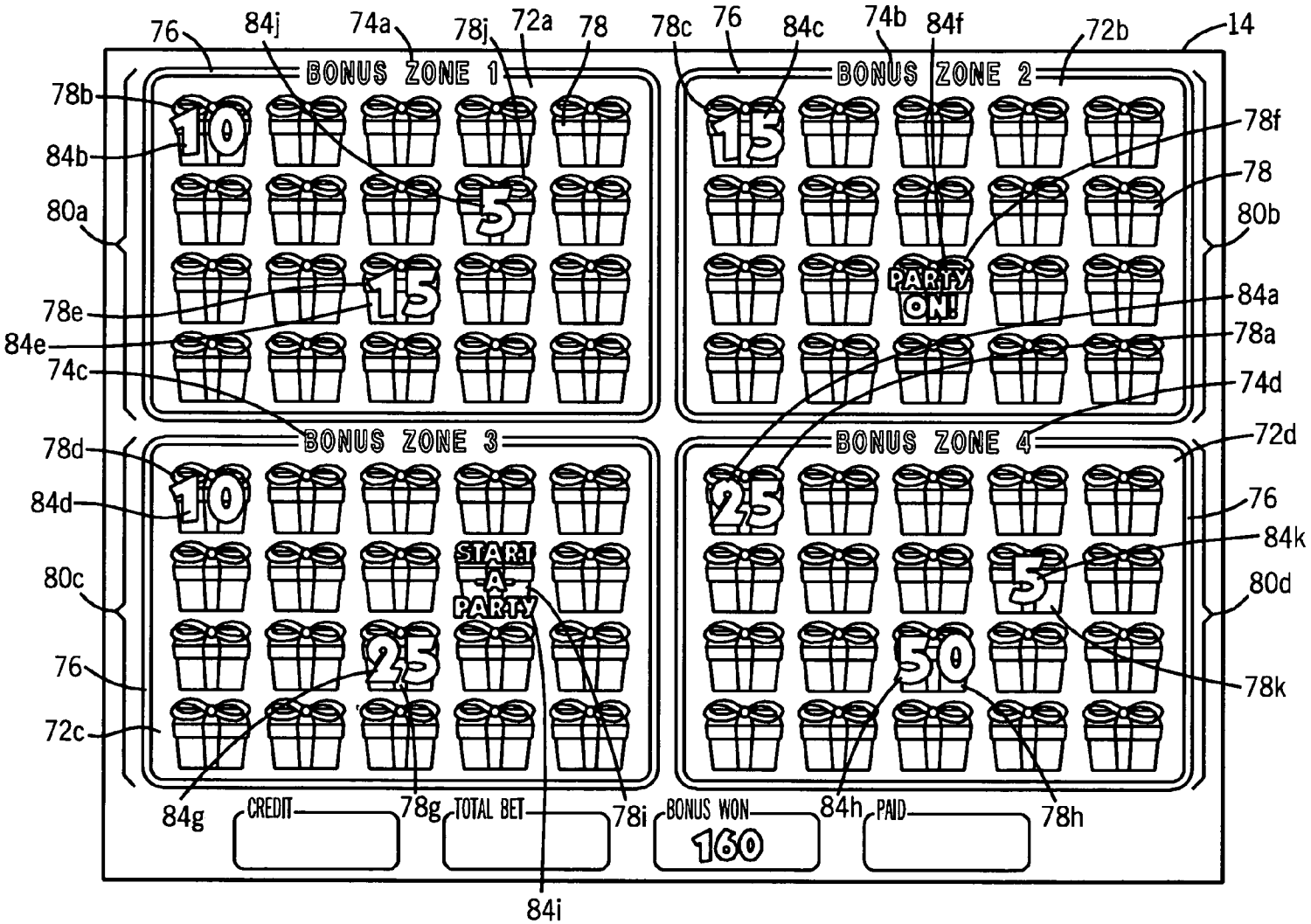
FIG. 10 is yet another screen shot of the multi-zone selection feature.
Figure 11:
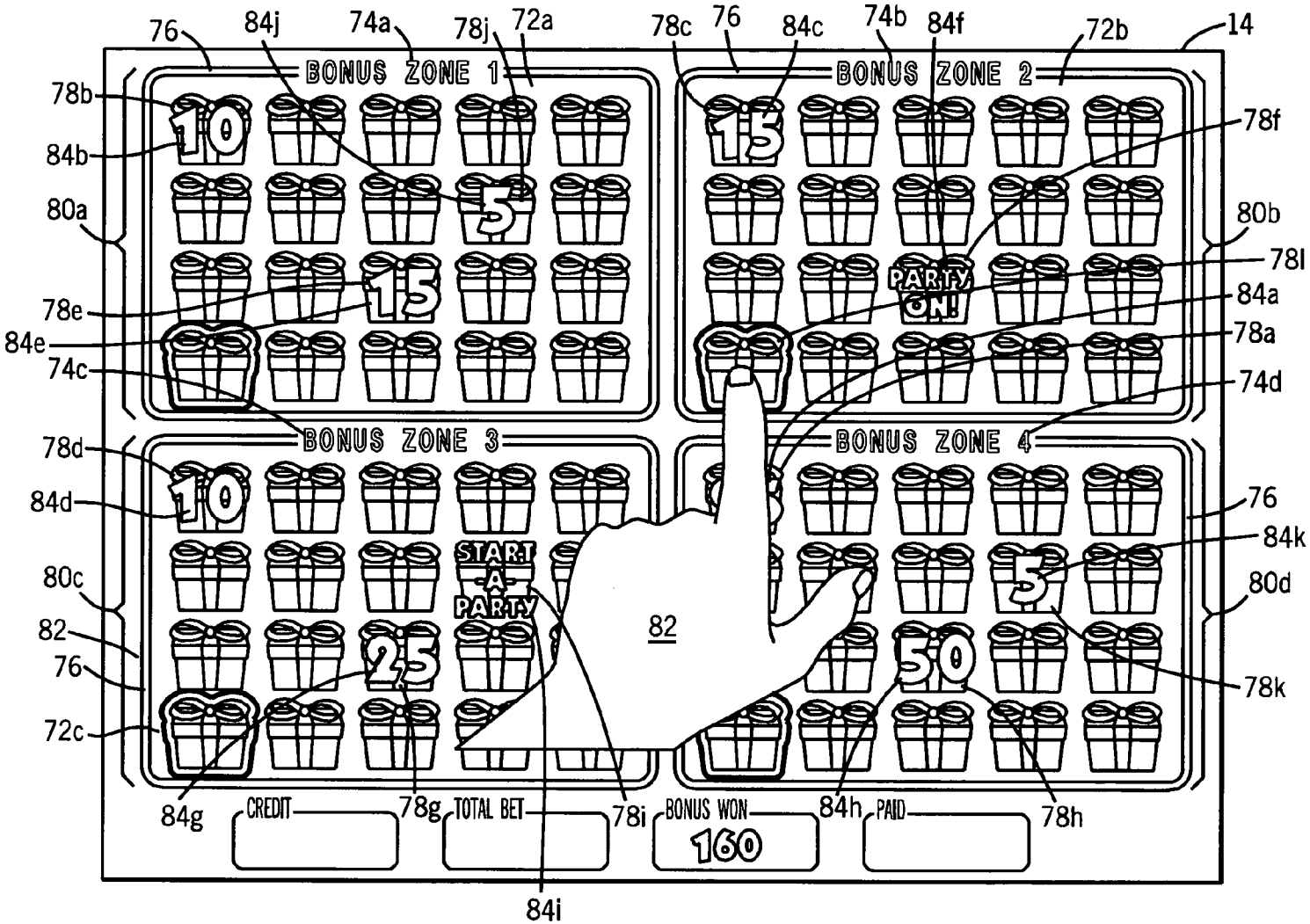
FIG. 11 is yet another screen shot of the multi-zone selection feature.

In FIG. 10, the player 82 is provided with the selection results 84*i,j,k* associated with the selected element 78*i*, and the two corresponding unselected elements 78*j,k*. The selection results 84*j,k* associated with the two corresponding unselected elements 78*j,k* are each credit awards of 5 credits, which are provided to the player 82. Because the second zone 72*b* is deactivated, the player 82 is not provided any selection results from that zone 72*b*. As before, the player 82 is also provided the selection result 84*i* associated with the selected element 78*i*, which in this case is a rejuvenator. When a selection results 84*i* which is a rejuvenator is provided, a previously deactivated zone, such as the second zone 72*b* in this instance, is reactivated. This is graphically communicated to the player 82 in one or more ways. As seen in FIG. 10, the rejuvenator itself is labeled "Start A Party" indicating to the player 82 that a previously deactivated zone 72 will be reactivated. Moreover, the shading or "graying" out of the deactivated zone 72*b* is removed, and the previously provided terminator is relabeled from "Party Over" to "Party On!". In this way, the rejuvenator serves to reactivate previously deactivated zones 72*b* for availability during continued play. Although in this embodiment, a rejuvenator serves to reactivate one deactivated zone, in other embodiments, a rejuvenator may reactive more then one deactivated zone, or even all of the deactivated zones. Moreover, if more than one zone has been deactivated, a rejuvenator may reactivate only one of the deactivated zones which is chosen at random from the deactivated zones. As seen in FIG. 11, once the previously deactivated zone 72*b* is reactivated, play continues and the player 82 is permitted to make yet another selection of the remaining active selectable elements 78. In this instance, the player 82 has selected element 781 from the second zone 72*b*, and will receive the selection result associated therewith, as well as the selection results from unselected elements in the corresponding locations in the other zones 72*a,c,d*.

Figure 12:
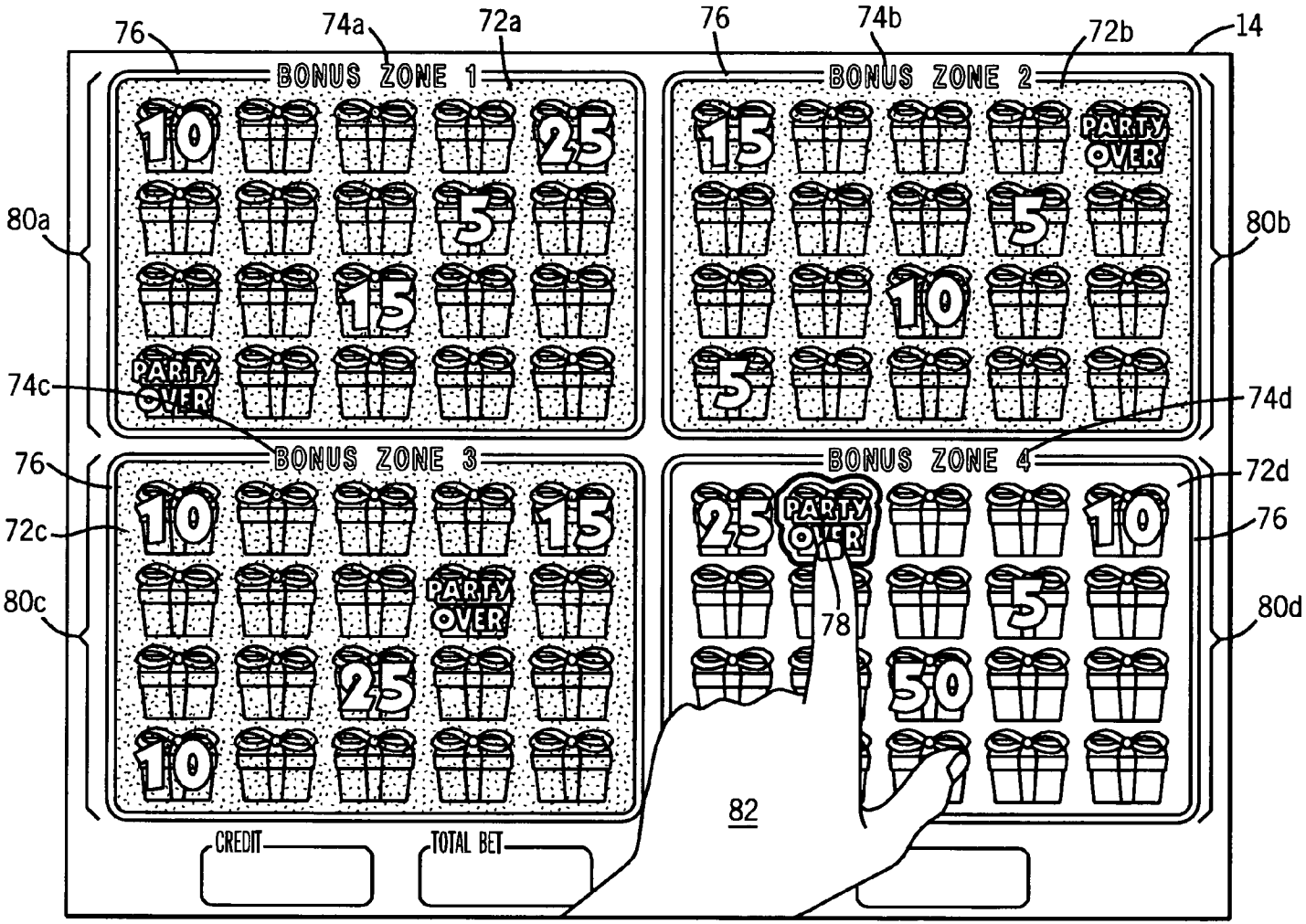
FIG. 12 is yet another screen shot depicting a conclusion of the multi-zone selection feature.

Turning to FIG. 12, the multi-zone selection game is depicted at its conclusion. In this embodiment, the player 82 is permitted to make selections from the selectable elements 78 until all four zones 72*a,b,c,d* have been deactivated. In FIG. 12, the player 82 is shown selecting from the only remaining active zone 72*d*. The selection made by the player 82 is associated with a terminator, thereby deactivating the last active zone 72*d* and terminating the multi-zone selection feature bonus game. In other embodiments, the player 82 may be provided with a fixed number of selections from the selectable elements 78. Moreover, the player 82 may be permitted to select from the selectable elements 78 until a predetermined number of zones 72*a,b,c,d* has been deactivated, or a predetermined number of activations and deactivations have occurred. In still other embodiments, other triggering events or criteria may be utilized to conclude or terminate the play of the bonus game. For example, the feature may terminate when the first terminator is revealed, or after a predetermined number of terminators are revealed, regardless of which zone 72 such terminators are located.

In the FIGS., the selectable elements 78 are shown associated with selection results 84 which include credit awards, terminators, and rejuvenators. However, in other embodiments, the selection results 84 may include other outcomes. For example, the selection results 84 may include multipliers, free spins, or other awards. Also, the selection results 84 may include outcomes which reset the bonus game, provide additional selections, automatically end the entire bonus game, add or remove zones 72 to the game, or other variations. Moreover, as described herein, selection results 84 which are terminators cause deactivation of the zone 72 in which they are located. However, in an alternative embodiment, a selection result 84 which is a terminator may be configured to cause deactivation of a zone 72 only if the selection result 84 is associated with a selected selectable element 78, but not if the selection result 84 was associated with an unselected selectable element 78. In this way, a particular zone 72 could be deactivated only if the player 82 makes a selection of a selectable element 78 in that zone 72 which happens to be a terminator. Terminators occurring in zones 72 other than the zone 72 containing the selected element 78 would not deactivate their respective zones, but rather would be eliminated terminators, thereby helping the player to achieve better results in the multi-zone feature.

Although the bonus feature described herein is depicted and described as occurring on the primary display 14, the feature may be implemented on the secondary display 16, or on any other display, such as a community display, or auxiliary display. Moreover, the bonus feature may be displayed on a plurality of displays, or as a unified image across multiple displays, as described in U.S. Pat. Nos. 6,254,481 and 6,569,018 to Jaffe and assigned to WMS Gaming Inc., which are incorporated herein by reference in their entirety. The multiple displays may be utilized to depict some or all of the plurality of zones 72 described herein for use and display of the multi-zone selection feature. Any number of configurations of displays may be used, singly or in combination, to display the multi-zone selection feature described. Moreover, the selection results 84 may be provided to players other than the player 82 making the selections. For example, in community games or other group games, the selection results 84 provided to the player 82 providing the selection may be alternatively, or additionally, awarded to other players in the casino who are eligible to receive such results 84.

Each of these embodiments and obvious variations thereof is contemplated as falling within the spirit and scope of the claimed invention, which is set forth in the following claims.

What is claimed is:

1. A gaming system comprising:

a wager input device;

a display device for displaying a randomly selected outcome, the randomly selected outcome selected from a plurality of possible outcomes; and a controller operative to display a multi-zone selection feature comprising a plurality of zones displayed on the display device, each zone having a plurality of selectable elements arranged in an array, each selectable element being associated with a selection result, the selection result corresponding to an award, a terminator, or a rejuvenator that is not displayed on the display device until the selectable element associated with the selection result is selected, wherein in response to selection of a first selectable element in a first one of the zones, displaying on the display device a first selection result associated with the first selectable element in the first zone and a second selection result associated with a second selectable element in a second one of the zones, and responsive to the first selection result being a first award and the second selection result being a second award, the controller being operative to award the first award and the second award prior to receiving a selection of a selectable element in the second zone.

2. The gaming system of claim 1, wherein the first and second zones have an equal number of selectable elements.

3. The gaming system of claim 1, wherein the position of the second selectable element in the array of the second zone is in the same as the position of the first selectable element in the array of the first zone.

4. The gaming system of claim 1, wherein the controller is further operative to, in response to the displaying the first selection result and the second result, receive a selection of a selectable element in the second zone.

5. The gaming system of claim 2, wherein the arrays in the first and second zones are congruent.

6. A method of conducting a wagering game for a human player on a gaming system, the method comprising the acts of:

receiving an indication of a wager from the player via a wager input device;

displaying on one or more display devices viewable by the player a randomly selected outcome, the randomly selected outcome selected from a plurality of possible outcomes;

in response to a triggering event, displaying on the one or more display devices a multi-zone selection feature comprising a plurality of zones, each zone having a plurality of selectable elements arranged in an array, each selectable element associated with a selection result selected from a plurality of possible selection results, each of the possible selection results including an award, a terminator, or a rejuvenator that is not displayed on the one or more display devices until the selectable element associated with the selection result is selected; and receiving an indication of a selection of a first selectable element in a first one of the zones, and in response to the receiving the indication of the selection, (a) providing, via one or more processors configured to execute computer instructions relating to the wagering game, and (b) displaying on the one or more display devices (i) a first selection result associated with the first selectable element in the first zone and (ii) a second selection result associated with a second selectable element in a second one of the zones prior to receiving a selection in the second zone;

in response to the displaying the first selection result and the second result, receiving an indication of the selection of a selectable element in the second zone.

7. The method of claim 6, wherein in response to one of the first or second selection results being a terminator, deactivating the one of the first or second zones from further selections.

8. The method of claim 6, wherein in response to one of the first or second selection results being a rejuvenator, reactivating a previously deactivated zone.

9. The method of claim 6, wherein the array in the first zone and the array in the second zone are congruent.

10. The method of claim 6, wherein the position of the first selectable element in the first zone is the same as the position of the second selectable element in the second zone.

11. The method of claim 6, wherein the triggering event comprises the randomly selected outcome being a start-bonus outcome.

12. The method of claim 7, wherein if the first selection result is a terminator, the first zone is deactivated and if the second selection result is a terminator, the second zone is deactivated.

13. A method of conducting a wagering game for a human player on a gaming system, the method comprising the acts of:

receiving an indication of a wager from the player via a wager input device;

displaying on one or more display devices viewable by the player a randomly selected outcome, the randomly selected outcome selected from a plurality of possible outcomes, the plurality of outcomes including a start-bonus outcome;

in response to the randomly selected outcome being the start-bonus outcome, displaying on the one or more display devices a multi-zone selection feature comprising a first zone, a second zone and a third zone, the first zone having a plurality of selectable elements arranged in a first array, the second zone having a plurality of selectable elements arranged in a second array, the third zone having a plurality of selectable elements arranged in a third array, each of the selectable elements in the first, second, and third zones being associated with a selection result selected from a plurality of possible selection results, each of the possible selection results including an award, a terminator, or a rejuvenator that is not displayed on the one or more display devices until the selectable element associated with the selection result is selected;

receiving, via one or more processors configured to execute computer instructions relating to the wagering game, a selection of a first selectable element of the selectable elements in the first zone; and prior to receiving a selection of any selectable element of the selectable elements in the second zone or in the third zone, providing, via the one or more processors, a first selection result associated with the first selectable element, providing, via the one or more processors, a second selection result associated with a second selectable element in the second zone, and providing, via the one or more processors, a third selection result associated with a third selectable element in the third zone.

14. The method of claim 13, wherein the number of selectable elements in the first, second, and third zones are equal.

15. The method of claim 13, wherein the position of the second selectable element in the second array is the same as the position of the first selectable element in the first array.

16. The method of claim 13, wherein if the first, second or third selection result is a terminator, the corresponding first, second or third zone is deactivated.

17. The method of claim 13, wherein the selecting step comprises receiving a player selection input.

18. A non-transitory computer readable storage medium encoded with instructions for directing a gaming system to perform the method of claim 13.

19. The method of claim 14, wherein the geometric arrangement of the selectable elements in the first, second and third arrays are the same.

20. The method of claim 15, wherein the position of the third selectable element in the third array is the same as the position of the first selectable element in the first array.

21. The method of claim 16, further comprising the steps of:

receiving an indication of a selection of a fourth selectable element in the first, second, or third zones;

providing a fourth selection result associated with the fourth selectable element; and providing a fifth selection result associated with a fifth selectable element.

22. The method of claim 16, wherein if either the fourth or fifth selection results is a rejuvenator, reactivating the deactivated zone.

* * * * *

UNITED STATES PATENT AND TRADEMARK OFFICE

CERTIFICATE OF CORRECTION

PATENT NO. : 8,371,920 B2
APPLICATION NO. : 12/446266
DATED : February 12, 2013
INVENTOR(S) : Gomez et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 593 days.

Signed and Sealed this
First Day of September, 2015

Michelle K. Lee

Michelle K. Lee
*Director of the United States Patent and Trademark Office*